United States Patent [19]

Eisbein

[11] Patent Number: 4,525,063

[45] Date of Patent: Jun. 25, 1985

[54] PAPER HOLDER FOR A PHOTOCOPYING MACHINE

[75] Inventor: Jürgen Eisbein, Gerlingen, Fed. Rep. of Germany

[73] Assignee: Develop Dr. Eisbein GmbH & Co., Fed. Rep. of Germany

[21] Appl. No.: 553,111

[22] Filed: Nov. 18, 1983

[30] Foreign Application Priority Data

Dec. 1, 1982 [DE] Fed. Rep. of Germany ..... 3244388

[51] Int. Cl.[3] ..... G30B 27/58

[52] U.S. Cl. ..... 355/72; 271/9; 271/145; 432/227; 206/449; 220/345; 220/334

[58] Field of Search ..... 355/72, 74, 133; 354/175, 176, 183, 174; 271/9, 105, 127, 126, 164, 170, 171, 145; 432/227, 9; 34/234; 206/449; 220/345, 334

[56] References Cited

U.S. PATENT DOCUMENTS 4,303,235 12/1981 Calabrese ..... 271/9

*Primary Examiner*—L. T. Hix
*Assistant Examiner*—Brian W. Brown
*Attorney, Agent, or Firm*—Barnes & Thornburg

[57] ABSTRACT

A paper holder, especially for a small office type photocopying machine or the like, is provided with two sections disposed one behind the other for respective stacks of paper sheets. The sections of the holder are disposed so that they can be selectively utilized with the one or the other ends of the holder inserted into the copying machine. Paper sheets are fed to the machine from the respective one of the sections inserted into the machine. The other sheet stack which may contain a paper of a different format or a different quality is then held in reserve in the same paper holder. The paper holder is provided with a heater in order to facilitate the drying of both stacks of paper and also so that the stack of paper held in reserve is immediately ready upon its insertion to give error free copying qualities.

14 Claims, 3 Drawing Figures

PAPER HOLDER FOR A PHOTOCOPYING MACHINE

BACKGROUND AND SUMMARY OF THE INVENTION

The invention relates to a paper holder for the receipt of a paper stack, especially for an office type photocopying machine of the type which is formed as a paper holder or case which is slidable into a copying machine and is adjustably movable into the region of the paper sheet feeding apparatus, which includes guides for the receipt and removal of the paper from the stacks. Such a paper holder is open at the end that is slidable into the paper machine to be disposed near the withdrawal or feeding device so as to accomodate the removal of individual paper sheets thereby.

When the paper stack of the paper holder is exhausted, the paper holder is removed from the copying machine, is filled with a new stack of paper, and is again inserted into the copying machine so that the copying process can proceed. Thus, for the later filling of the paper holder with a fresh stack of paper another holder or package must be opened, which many times is disposed in a location remote from the copying machine. During this time, the copying machine cannot be used so that a certain time is lost for the replenishment of paper supply.

An object of the invention is to construct a paper holder of the above mentioned kind that with the exhaustion of a stack of paper, the replenishment of paper supply to the machine can be completed with a minimum loss of copying time.

This object is achieved by providing a paper holder with two sections, disposed one behind the other, for the acceptance of respective stacks of paper, the oppositely disposed ends of which sections are open and have a similar configuration at least over the respective required length region for accomodating insertion into the copying machine for withdrawal of sheets by the paper feeding mechanisms.

With the arrangement of the invention it is possible to hold a second stack of paper for storage inside of the same paper holder so that upon the exhaustion of one stack of paper, the paper holder need only be removed and be reinserted with the other end to facilitate continuation of the copying procedure. The then exhausted paper holding section will be located outside of the machine and be accessible for refilling without interrupting the copying process.

It is also known to so design a copying machine that different paper formats can be used. Arrangements have been contemplated where a single paper holder is used that is adjustable to different paper formats. These adjustments from one paper format to another are very time consuming and involve many steps. It has also been contemplated for different formats to have respectively separate paper holders for each format with format changes involving exchange of the paper holders. This means however that the paper holder with the format not in use must be stored. Also it is often a tedious and awkward procedure to locate and exchange the second paper holder expecially if it is stored remote from the copying machine as often is the case for small desk top copiers.

In order to avoid the above-mentioned difficulties, certain preferred embodiments of the invention provide that the sections have adjustable guides which are independent of the corresponding adjustable guides of the other section of the paper holder. Thereby it is possible with a single paper holder to have two stacks of paper with different formats stored therein so that changing to another format only involves a simple removal of the paper holder, turning of same around and reinsertion into the machine.

In locations with higher humidity in the air it has been contemplated to provide the paper holder with a heater through which the paper that is disposed in the paper holder is dried. This drying assures an error free copy quality. If however, a new stack of paper is inserted into a paper holder of this type there exists the danger that this new stack of paper is consisting of relatively damp paper so that the desired copy quality is not achieved because the paper is insufficiently dried. In order to avoid this difficulty, it is provided according to certain further preferred embodiment of the invention that the floor or bottom of the paper holder is provided with a heater which is connectable to contacts of the copying machine and which heater extends over both sections of the holder. Thereby it is achieved that also in the section which is not being used, the paper is dried so that the stored paper stack with the other format is filled with preheated predried paper sheets which assures error free copy quality.

Further objects, features, and advantages of the present invention will become more apparent from the following description when taken with the accompanying drawing which show, for purposes of illustration only, embodiments in accordance with the present invention.

DETAILED DESCRIPTION OF THE DRAWINGS

Figure 1:
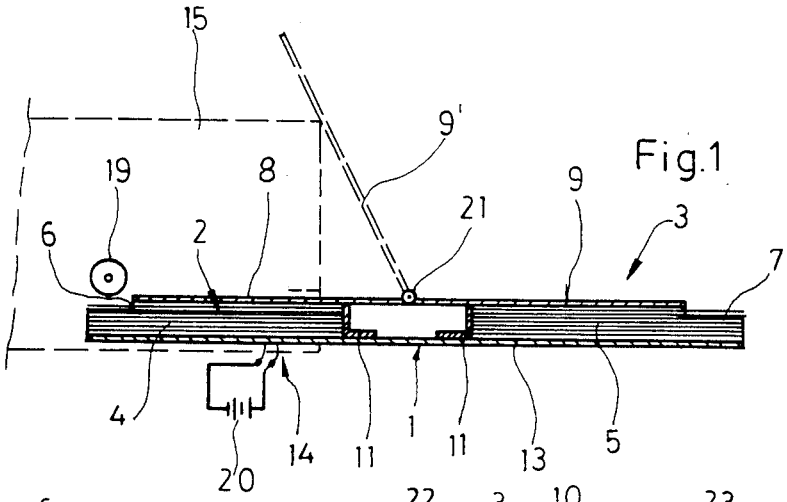
FIG. 1 is a longitudinal sectional view showing a paperholder constructed in accordance with the present invention, depicted schematically in an inserted position in a photocopying machine.

In FIG. 1, the end of an office desk top type copying machine 15 is shown schematically in dash lines. A paper holder is shown inserted into copying machine 15 with section 2 thereof holds a stack of paper in a position ready for use. The paper holder 1 is inserted into the copying machine 15 so far that the open end 6 of the section 2 is disposed adjacent a paper sheet withdrawal device 19 which includes at least two withdrawal rollers. Further details of the photocopying machine have been dispensed with herein in order not to obscure the present invention. It will be understood by those skilled in the art that the copying machine will have devices for separating and removing the individual sheets of paper from the paper holder 1 and further processing the sheets to make copies.

The paper holder 1 is preferably made as a plastic paper holder including two paper holding sections 2, 3 disposed one behind the other for receiving respective stacks of paper 4, 5. The respective opposite ends 6, 7 of the sections 2, 3 are open and similarly shaped so that either section 2 or section 3 can be inserted into an in use position in the copying machine with the respective paper stacks disposed adjacent the withdrawal device 19.

The paper holder includes a floor 13 and two side walls. The facing side of the side walls can be provided as needed with paper guide means, especially corner separators for the stack of paper. In the region of the open ends 6 and 7 the side walls are partially cut out in order to leave the upper side of the stack of paper exposed to permit withdrawal of sheets by withdrawal device 19. The sections 2 and 3 are covered with hinged covers 8 and 9 which for example, are bearingly supported in a common pivot link 21 that is arranged at the side walls in a not further illustrated cross frame piece between the side walls.

When the paper holder 1 is inserted into the copying machine 15 with its section 2, the section 3 can be opened by means of cover 9 (position 9') to expose section 3, for refilling with a paper stack. After exhaustion of the stack of paper 4 in section 2, the paper holder 1 is pulled out of the copying machine, turned 180 degrees about a vertical axis, and reinserted into the machine with the section 3 first so that now the stack of paper in section 3 can be used. Thereafter, the section 2 can be filled with a new paperstack after opening of the cover, without interruption of the copying process.

Figure 3:
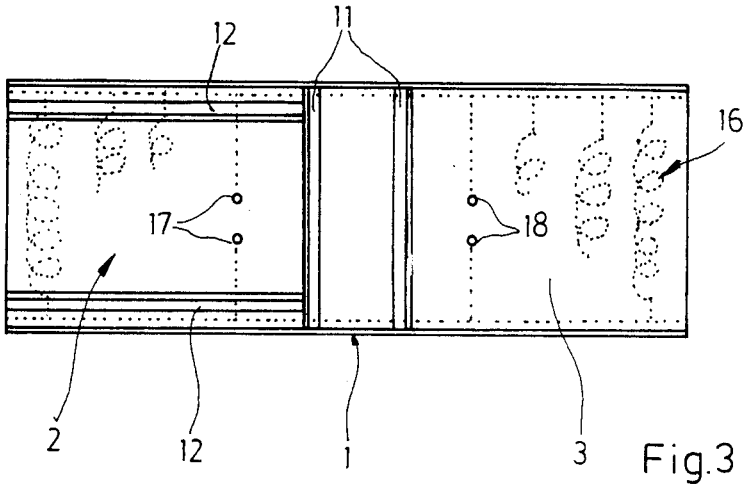
FIG. 3 is a top view of a paper holder constructed in accordance with the illustrations of FIGS. 1 and 2 with the cover removed for purposes of illustration.

Paper stacks 4 and 5 with different formats can be utilized in sections 2 and 3 in the manner shown, for example, in FIG. 3. The two sections, 2 and 3, are provided with respective cross and length guides 11 and 12 for the paperstacks, which guides are independent from one another so that each section can be independently arranged for receiving stacks of paper with different formats. In section 3, as illustrated in FIG. 3, the sidewalls serve for the cross guiding of the stack of paper at the maximal format width. For guidance in the longitudinal direction, there is a guiding rail 11 provided, which in a not further illustrated manner is fastened at the floor 13 of the paper holder 1, for example with the help of screws. In the section 2, as illustrated in FIG. 3, the length guidance is effected by means of a guiding rail 11 which is adjustable like the rail of the section 3 described above. The cross guiding or side guiding of the paper stack in section 2 is effected through two angle profile guide rails 12, which are detachably fastened at the floor of the paper holder 1, for example, by screws.

In the illustrated embodiments the paper holder in the regions of the sections 2 and 3 is guided into the copying machine 15 with its outer contour. The length region to be guided into the copying machine of both sections 2 and 3 must therefore have correspondingly similar outer contours at least over this longitudinal region. Embodiments are also contemplated wherein it is provided that at least one guide rib is provided in the copying machine 15 which is disposed to accomodate a corresponding opening in the floor 13 of the paper holder 1, which guide rib and openings respectively extend over the length that is to be guided into the copying machine 15. A limitation in the outer contour is then not required for the two sections 2 and 3 with such an embodiment.

Figure 2:
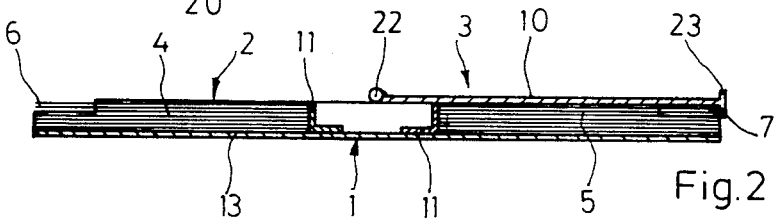
FIG. 2 is a longitudinal sectional view showing a paperholder constructed in accordance with another preferred emobidment of the invention.

According to the embodiment of FIG. 2, in which the stacks of paper sheets 4 and 5 have different lengths, there is a common hinge cover 10 provided for both sections 2 and 3 which is connected in the middle between the two ends 6 and 7 of the paper holder 1. Cover 10 is so dimensioned that it respectively covers one of the sections 2 or 3 over the full length thereof, also in the region of the open end of the part of the stack of paper to be inserted in the machine. The hinged cover 10, on its protruding end over the sections 2 and 3 is provided with a cross-member 23 extending towards the top and the bottom, which covers the sheet of paper in both respective sections. Especially in this FIG. 2 embodiment, it is possible to use the portion of the holder protruding outside of the copying machine as a storage space (on top of backside of cover 10) for the originals to be copied or the like.

Instead of the hinge cover 10 of FIG. 2, embodiments are also contemplated which use a slide cover which is guided at both sides of the paper holder 1 and which is approximately half the length of the paper holder 1. Such a slide cover should preferably extend over the length of the paper holder 1 which extends outwardly of the machine when the paper holder is inserted into the machine.

The paper holder 1 is provided in the region of its floor 13 with a heater which in the embodiment example is formed of insulated heating coils which are arranged between two metal foils, preferably aluminum foils, and which are disposed at the floor 13 and especially are glued at the floor 13. The heating coils are provided with current by means of contacts 14 of the copying machine 15, which in FIG. 1 are shown with the energy source 20. The paper holder 1 is provided with contact pairs 17 and 18 respectively in the region of the sections 2 and 3, which contact pairs 17 and 18 are arranged with respect to contact 14 of the copying machine so that independently of which of the sections 2 or 3 are inserted into the copying machine 15, the heater 16 is provided with current. Thereby it is achieved that also the respective stack of paper 4, 5 disposed outside of the copying machine to serve as a storage stack or a stack of other material or other format, is provided with pre-drying.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Paper holder for a photocopying machine of the type which holds stacked paper sheets to be copied on and which is selectively insertable into the machine to a position accomodating machine withdrawal of sheets therefrom, said paper holder comprising first and second stack holding sections disposed one behind the other, said sections exhibiting respective oppositely facing end regions which are sufficiently similarly configured to accomodate selective insertion of the paper holder with a respective one or the other of the stacks in the sections being accessible to a paper withdrawing mechanism of a photocopying machine.

2. Paper holder according to claim 1, wherein the sections are each provided with hinged covers.

3. Paper holder according to claim 1, wherein a single hinged cover is mounted for pivotal movement about a pivot axle disposed between the sections and selectively movable to cover one or the other of the sections.

4. Paper holder according to claim 1, wherein a common slide cover is provided for selectively covering the respective ones of the sections, said slide cover extending over approximately half the total length of the paper holder.

5. Paper holder according to claim 1, wherein adjustable paper format guides are provided in each of the sections, the guides in the respective sections being independently adjustable.

6. Paper holder according to claim 2, wherein adjustable paper format guides are provided in each of the sections, the guides in the respective sections being independently adjustable.

7. Paper holder according to claim 3, wherein adjustable paper format guides are provided in each of the sections, the guides in the respective sections being independently adjustable.

8. Paper holder according to claim 4, wherein adjustable paper format guides are provided in each of the sections, the guides in the respective sections being independently adjustable.

9. Paper holder according to claim 1, wherein the sections are bounded at the bottom by a floor which includes paperstack heating means arranged thereat, said heating means extending over both sections and being in electrical contact with current supply contact means of a copying machine in both its inserted positions, said heater being configured to dry both stacks of paper in the sections simultaneously.

10. Paper holder according to claim 9, wherein each of the sections is provided with a pair of electrical contacts at the floor of the paper holder, both pairs of contacts being connected to supply current to the heating means when either of the pairs is in contact with the copying machine contacts.

11. Paperholder according to claim 1, wherein the respective opposite open ends of the two sections have similar outer contour configurations for mating with guide surfaces at a copying machine.

12. Paper holder according to claim 1, wherein the respective opposite end regions of the floor of the sections are provided with similarly shaped axially extending guide means for mating with guide means at a copying machine.

13. Paper holder according to claim 5, wherein the sections are bonded at the bottom by a floor which includes paperstack heating means arranged thereat, said heating means extending over both sections and being in electrical contact with current supply contact means of a copying machine in both its inserted positions, said heater being configured to dry both stacks of paper in the sections simultaneously.

14. Paper holder according to claim 13, wherein each of the sections is provided with a pair of electrical contacts at the floor of the paper holder, both pairs of contacts being connected to supply current to the heating means when either of the pairs is in contact with the copying machine contacts.

* * * * *